United States Patent [19]

Donaldson et al.

[11] 4,171,581

[45] Oct. 23, 1979

[54] WATER FLOW-DEFLECTING SHIELD FOR DREDGE SUCTION NOZZLE

[75] Inventors: Robert M. Donaldson; Ted W. Christian; Glen E. Miller, all of Newport News, Va.

[73] Assignee: Deepsea Ventures, Inc., Gloucester Point, Va.

[21] Appl. No.: 851,515

[22] Filed: Nov. 14, 1977

[51] Int. Cl.[2] ..... E02F 3/92

[52] U.S. Cl. ..... 37/58; 37/79; 37/DIG. 8

[58] Field of Search ..... 37/54, 55, 57, 58, DIG. 8, 37/79

[56] References Cited

U.S. PATENT DOCUMENTS

| | | | |
|---|---|---|---|
| 1,070,271 | 8/1913 | Lybeck | 37/55 |
| 3,456,371 | 7/1969 | Graham et al. | 37/DIG. 8 |
| 3,962,803 | 6/1976 | O'Brien | 37/57 X |
| 3,988,843 | 11/1976 | Brockett | 37/57 |

*Primary Examiner*—Clifford D. Crowder

*Attorney, Agent, or Firm*—Barry G. Magidoff

[57] ABSTRACT

Apparatus for directing flow of water passing an ocean floor dredge head into a downwardly direction, and deflecting water from directly impinging upon the dredge nozzle body. The invention comprises a dredge vehicle chassis from which is pivotally suspended a dredge nozzle body and a water-flow deflecting shield, forwardly of the nozzle. Both the nozzle body and the shield are substantially vertically elongated members suspended substantially by the top of each element from the vehicle chassis.

7 Claims, 4 Drawing Figures

WATER FLOW-DEFLECTING SHIELD FOR DREDGE SUCTION NOZZLE

This invention relates to means for providing the deflection of water in front of a dredge head, especially of the type useful for the recovery of ocean floor nodule ores.

With the recognition of the limited supplies of raw materials, and especially metals, from previously available terrestrial mine sites, a great deal of effort has been put into the development of means to mine valuable metal ores from the abyssal depths of the oceans. Such means have generally centered about the utilization of extremely deep water dredging means, especially at depths of between 10,000 and 18,000 feet, to bring up what is known as ocean floor nodule ore, or manganese nodules.

The extreme conditions met at such great ocean depths, particularly in the way of pressures, have necessitated the development of a new generation of dredging equipment. Generally, a dredging means is connected to a surface vessel by way of a device for bringing the ore from the ocean floor to the surface. The dredging head can be, for example, of the suction nozzle variety, wherein the ore is literally sucked into a nozzle, much in the way of a vacuum cleaner, and then transferred to the vertical means rising to the surface. Such vertical means, generally utilized in combination with a suction head nozzle, include hydraulic means for lifting the ore suspended in, generally, water. Mechanical means for the removal of such ocean floor ores have also been utilized, including, for example, continuous bucket chains or digging scoops.

Generally, the dredging means, of whatever type, are pulled through the water utilizing, for example, the length of pipe for hydraulically lifting the ore from the floor to the surface vessel. The dredging means, and particularly the suction nozzle head, is thus subject not only to the pressures at the abyssal depths but also to the problems of hydrodynamic drag created by the continuing flow of water as it is moved along the ocean floor, by towing, as well as problems of solid obstacles on the generally not well charted ocean floor.

Because of the inability of man to survive and work at these great depths, even by utilizing the newest experimental techniques, the operation of such dredges has necessarily entailed telemetric controls. Such long distance operation of a device has, of course, decreased the efficiency of collection of the operation; but such inefficiency has been, of necessity, accepted as part of the risks of any such venture. In an attempt to improve the recovery rate, for example, of the suction head nozzle type devices, mechanical means have been employed, such as by way of fingers or probes, thrusting ahead of the nozzle opening to loosen the nodule particles from the ocean floor. Although this has been at least partially successful, there has also been a great deal of loss caused by these particles being swept away along the side of the nozzle as it is being pulled through the water.

Deposits of valuable metal ores are found lying on the surface of the soft sea floor as nodules, or as generally fist-sized "rocks" which are only partially immersed within the sediment on the ocean floor. The nodule materials, of course, vary greatly in size, from what can be considered relatively small pebbles or even grains, up to relatively large rocks, or even boulders. Granite and other stone boulders are of course also often encountered when passing along the deep ocean floor.

It is accordingly an object of the present invention to provide means to improve the effectiveness of a dredge head in removing nodules and other ore of a like particulate nature from the ocean floor.

It is a further object of this invention to provide means to shield a dredge head from obstacles and hydrodynamic forces which tend to interfere with the removal of the ore.

In accordance with the present invention there is provided a dredging vehicle adapted to be moved in a forward direction, dredging means supported by the vehicle and having a dredge inlet adjacent the bottom of the vehicle, and water-deflecting means supported on the vehicle forwardly of the dredging means and designed to deflect water flowing from the front towards the rear of the vehicle downwardly towards the dredging inlet. In a preferred embodiment, dredging means comprising a suction nozzle having a nozzle inlet located adjacent the bottom of the nozzle is operatively connected to water-deflecting means, located forwardly of the nozzle and designed to deflect water flowing towards the nozzle downwardly towards the nozzle opening. The nozzle opening is further preferably facing in a generally forwardly, and most preferably obliquely downwardly, direction. The combination of the effect of the downwardly deflected water and of the obliquely opening nozzle dramatically improves the ability of the nozzle to recover particulate material along its path.

The water flow-directing means can be formed integral with the dredge, specifically with the suction-type nozzle means. In this embodiment, the forward surface of the suction-type nozzle is formed, as by casting or molding, into a hydrodynamic surface so designed as to deflect water flow impinging upon it from a forward direction downwardly towards the nozzle opening. Preferably, however, it has been found to be even more effective to utilize a separate water flow deflecting means, loated forwardly of the nozzle and optimally pivotally supported independently of the nozzle. The deflecting means can be pivotally supported directly from the dredge vehicle or it can be pivotally supported from the nozzle.

In a most preferred embodiment, the nozzle presents a vertically elongated surface facing forwardly towards the free-stream flow of water and is pivotally connected to the vehicle. The water flow deflecting means is also in turn pivotally connected to the vehicle, either directly, or indirectly connected via the upper forward portion of the nozzle. The nozzle is pivotable about a substantially horizontal axis extending transversely, preferably substantially perpendicularly, to the direction of water flow.

The independently supported flow directing means, is also preferably formed having sufficient structural strength so as to act as a physical shield to protect the nozzle against any solid obstructions that may be encountered as the dredge vehicle moves along the ocean floor. Furthermore, in the case of a pivotable nozzle, the independently suspended flow deflecting shield serves to prevent the raising of the nozzle above the level of the sea floor by the hydrodynamic drag force of the free-stream flow of water as the vehicle moves through the water and at the same time serves to protect the nozzle, and also to limit its upward swing, upon encountering solid obstacles in its path.

A further understanding of the present invention can be obtained by reference to the preferred embodiments for achieving the desired objects set forth in the illustrations of the accompanying drawing. The illustrated embodiments, however, are merely exemplary of certain presently known preferred means for carrying out the present invention. The drawings are not intended to limit the scope of this invention, but merely to clarify and exemplify, without being exclusive thereof.

Referring to the drawings.

Figure 1:
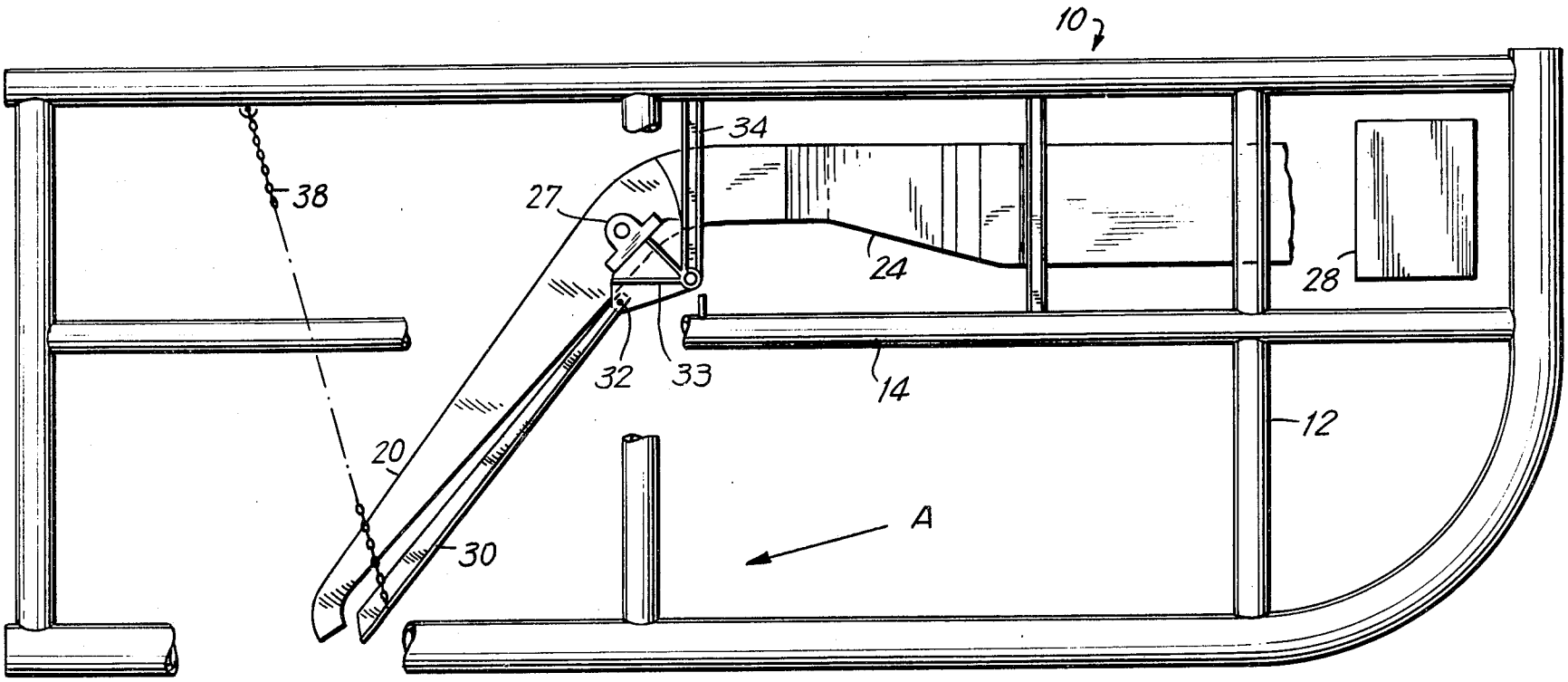
FIG. 1 is a partially broken away side elevation view of a dredge vehicle including the present invention.

A dredge vehicle chassis, generally indicated by the numeral 10, is formed of a plurality of intersecting vertical tubular members 12 and horizontal tubular members 14. A suction head nozzle 20 is supported by the chassis 10 via a flex block 27. The nozzle 20 is in turn flexibly connected to the water conduit 24, which is in turn in fluid-flow connection with manifold 26 and then with a suction pump, indicated generally by the numeral 28.

As shown in this embodiment, the nozzle 20 has a generally vertically elongated surface area presented to the free stream flow of water, moving relative to the nozzle in the direction indicated by the arrow A when the dredge vehicle is moving during the dredging operation. Interposed immediately forwardly, and slightly below the vertically obliquely laying nozzle 20 is a water-flow deflecting shield 30, pivotally supported at its upper end, via pin 32, on horizontally extending flange 33; the flange 33 is rigidly connected to the tubular chassis members 12, 14, via column 34, and to flex block 27.

Figure 4:
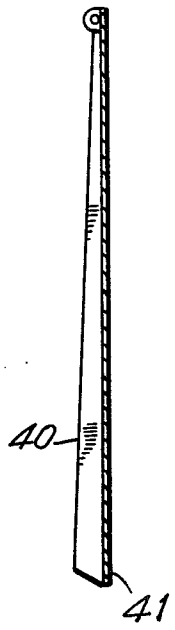
FIG. 4 is a view taken along lines 4—4 of FIG. 3.
Figure 3:
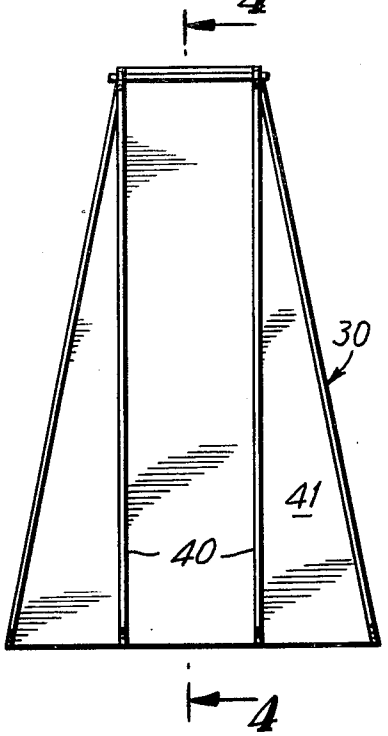
FIG. 3 is a detailed view of the water flow deflection shield means of the present invention.
Figure 2:
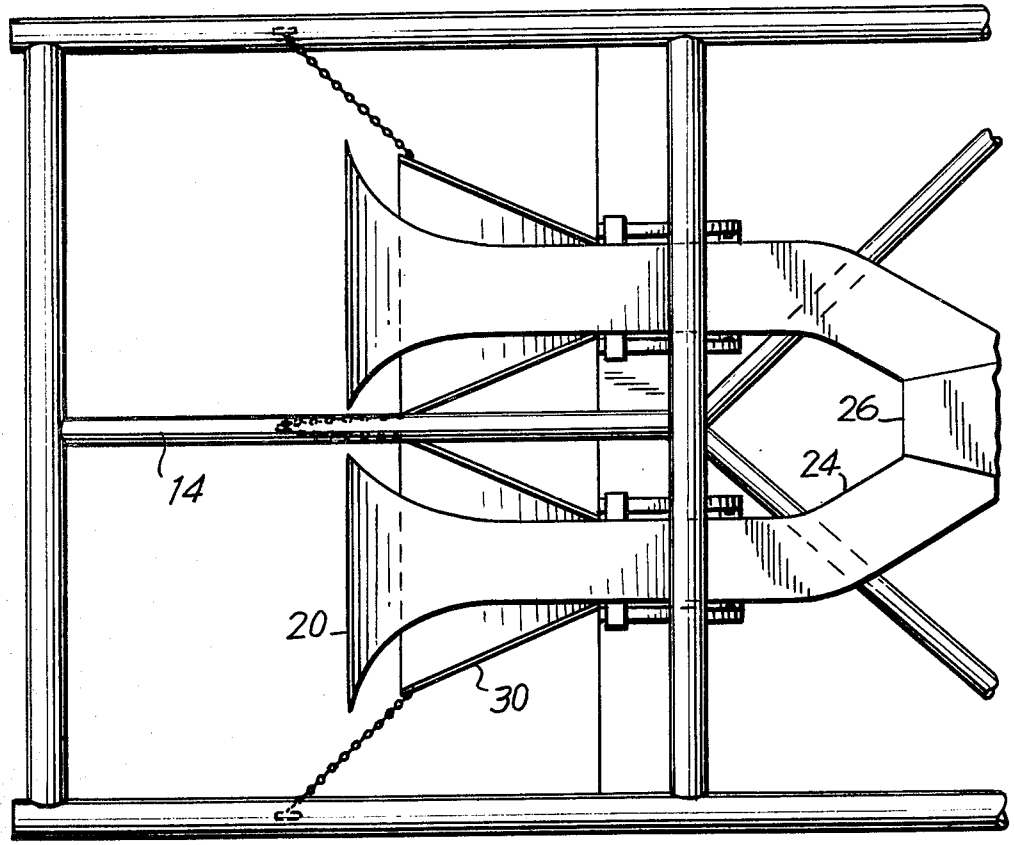
FIG. 2 is a plan view of the vehicle of FIG. 1 showing two dredge heads in side by side relationship.

Those skilled in the art of designing hydrodynamic surfaces are well aware of the myriad possibilities for the front surface and cross-sectional shape of a water-flow deflecting means for providing the desired downward deflection of the water as required by the present invention. It has been found, suprisingly, that a simple flat plate provides sufficient efficiency, at least at the relatively low speeds at which the dredge vehicle is expected to travel, and therefore, at the relatively low flow rates of the water and dredge vehicle. Accordingly, deflecting shield 30 as shown in FIGS. 3 and 4, is formed of a flat, thin plate 41, formed in the shape of a trapezoid, of decreasing width toward the upper end, and, in the embodiment shown, stiffened by two vertical rib plates 40. The stiffening is only required because of the weight saving effect of utilizing relatively thin plates, which therefore ordinarily have greater undesirable flexibility.

The upwardly converging shape of the deflector shield is dictated by the generally similar configuration of the nozzle, which, as shown, is generally wider at the bottom than at its upper end. The nozzle can be formed of a relatively lightweight, easily formed material, such as rigid P.V.C. plastic material, which is easily molded or otherwise formed to the desired nozzle shape. This permits an extremely simple, and relatively economical, means of forming a nozzle having the most efficient shape from the point of view of suction flow. The shield plate, would thus be formed of a relatively strong, dense material, such as aluminum metal or steel, and would absorb any sharp impact, for example from any solid obstructions met with during the travel of the dredge vehicle 10. Furthermore, when a relatively large obstruction is met and the drag baffle is pivoted in an upwardly direction, the nozzle is moved upwardly at the same time, pivoting about its axis through flex block 27.

The deflector shield 30 is maintained at the desired angle, relative to the horizontal, by the chains 38 extending from a location adjacent the bottom end of each side of the plate 30 to an upper horizontal member 14 of the dredge chassis 10.

The flow-deflecting shield further serves to prevent any undesirable upward movement of the relatively lightweight nozzle 20 caused by the impact of the water flowing against its forward surface, which would occur except for the presence of the relatively heavy shield plate 30 deflecting the water downwardly.

It has been found that the forward surface 31 of the shield plate 30 preferably should extend along a plane forming an angle of from about 45° to about 60° with the support surface for the vehicle, e.g., the horizontal, and most preferably from about 50° to about 55° when at rest. This angle can be varied by loosening or tightening the chains 38. Most generally, the "support surface" of the vehicle can be at a wide variety of angles, and in the case of the skids or sled-type vehicle of the drawings, is parallel to the lower horizontal chassis member 14.

The dredge vehicle can be any of a variety of devices, including the sled-type vehicle shown in the drawings, a wheeled vehicle, a tracked vehicle, or other means of supporting the dredge head means above, or on, the surface of the ocean floor. Any type of vehicle now known or developed in the future, including those which are self-powered or merely towed can be utilized. Similarly, any materials can be used for the construction of the vehicle, the nozzle, of the water-deflecting shield means, including any of the metals or synthetic polymeric plastic materials now known or to be developed or discovered in the future.

The spacing between the water-deflecting shield and the forward surface of the nozzle is apparently also relevant to the net drag force acting against the nozzle. Generally, the optimum spacing for a minimum net drag force is preferably determined empirically for each dredge vehicle. Any net drag force acting on the nozzle is compensated for by the weight of the nozzle itself, or by extra weights placed upon a trailing shoe connected to the bottom of the nozzle, or other known means, such as a downward acting hydrofoil.

It has been found to be desirable to include a plurality of dredging means, e.g., nozzles, suspended from a single vehicle. As an example, each nozzle is independently pivotally suspended about an axis parallel to the surface upon which the vehicle rides and perpendicular to the intended direction of movement, so as to permit each such nozzle to ride over an undulating or uneven surface independently. Each pivotable nozzle, therefore, can be pivoted above the surface of the sea bottom by not only a solid obstacle, but by the drag effect of the relatively moving water. This drag effect has conventionally been overcome by the use of weights. However, the weights have tended to press the nozzle into the sea bottom when the vehicle is still or moving at very slow speeds. The flow-deflecting shield of the present invention avoids this problem also, by shielding the nozzle from the drag of the water, and thus at least substantially reducing the size of any such weights.

The patentable embodiment of this invention which are claimed are as follows:

1. A dredge vehicle, capable of moving along the bottom of a body of water, the vehicle comprising a chassis, a suction-type dredging nozzle body having a substantially vertically elongated surface facing in a forward direction and a nozzle opening at the bottom of said surface facing in a forward direction, the nozzle body being pivotably supported from its top upon the chassis and a water flow-deflecting shield pivotably supported from its top upon the chassis at a location forward of and adjacent to the forwardly facing surface of the nozzle, the shield having a forward-facing shield surface which angles downwardly rearwardly from the pivotable support so as to downwardly deflect, towards the nozzle opening, a free flow stream of water impinging upon the forward shield surface.

2. The dredge vehicle of claim 1 comprising stop means for maintaining the shield at a forward rest position and wherein the forward shield surface of the water-deflecting shield extends, at rest, at an angle in the range of from about 45° to about 60° to a plane parallel to the chassis members designed to support the dredge vehicle during its forward movement.

3. The dredging means of claim 2 wherein the forward shield surface of the water-deflecting means decreases in width in an upwardly direction.

4. The dredge vehicle of claim 1 wherein the nozzle opening faces in a generally forwardly and obliquely downwardly direction.

5. The dredge vehicle of claim 4 wherein the vehicle chassis comprises skid means for travelling over the surface of the ocean floor.

6. The dredge vehicle of claim 4 wherein the water-deflecting means is pivotally connected to the chassis about a horizontal axis extending substantially transverse to the direction of flow and wherein the deflecting means extends forwardly of the nozzle and along substantially the entire length of the nozzle, whereby the impingement of water against the front surface of the nozzle as the dredging vehicle moves forwardly through the water is substantially prevented.

7. The combination of claim 1 wherein the shield is substantially rigid.

* * * * *

UNITED STATES PATENT AND TRADEMARK OFFICE

CERTIFICATE OF CORRECTION

PATENT NO. : 4,171,581

DATED : October 23, 1979

INVENTOR(S) : Robert M. Donaldson et al.

It is certified that error appears in the above—identified patent and that said Letters Patent is hereby corrected as shown below:

In [57] ABSTRACT - First line:

Please insert --the-- after "directing" and before "flow".

Signed and Sealed this

*Twenty-second* Day of *April 1980*

[SEAL]

*Attest:*

SIDNEY A. DIAMOND

*Attesting Officer*

*Commissioner of Patents and Trademarks*